US008564527B2

(12) United States Patent
Chu

(10) Patent No.: US 8,564,527 B2
(45) Date of Patent: Oct. 22, 2013

(54) TEMPERATURE COMPENSATING ARRANGEMENT FOR LIQUID CRYSTAL DISPLAY

(75) Inventor: Hong-Sig Chu, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 2217 days.

(21) Appl. No.: 11/491,014

(22) Filed: Jul. 21, 2006

(65) Prior Publication Data

US 2007/0085803 A1 Apr. 19, 2007

(30) Foreign Application Priority Data

Oct. 18, 2005 (KR) ..... 10-2005-0098218

(51) Int. Cl.
*G09G 3/36* (2006.01)

(52) U.S. Cl.
USPC ..... 345/101; 345/94

(58) Field of Classification Search
USPC ..... 345/101, 87–100, 102–104; 349/72, 349/199; 348/244
See application file for complete search history.

(56) References Cited

U.S. PATENT DOCUMENTS 3,921,162 A * 11/1975 Fukai et al. ..... 345/101
6,614,416 B1 * 9/2003 Yamamoto et al. ..... 345/94
2003/0164813 A1 * 9/2003 Fujii ..... 345/101

FOREIGN PATENT DOCUMENTS

JP 07-074574 A 3/1995
JP 7-141039 6/1995
JP 2004-85858 3/2004
KR 10-0315121 11/2001

OTHER PUBLICATIONS

Patent Abstracts of Japan, Publication No. 07-141039, Jun. 2, 1995, 1 p.
Patent Abstracts of Japan, Publication No. 2004-085858, Mar. 18, 2004, 1 p.
Korean Patent Abstracts, Publication No. 1020010056031 A, Jul. 4, 2001, 1 p.

* cited by examiner

*Primary Examiner* — Jonathan Horner
(74) *Attorney, Agent, or Firm* — Innovation Counsel LLP

(57) ABSTRACT

A circuit generates a reference voltage in inverse proportion to the variation in temperature to control the gate-on voltage for a gate line of a liquid crystal display so that the liquid crystal display may display an image without distortion.

8 Claims, 5 Drawing Sheets

TEMPERATURE COMPENSATING ARRANGEMENT FOR LIQUID CRYSTAL DISPLAY

CROSS-REFERENCE TO RELATED APPLICATION

This application relies for priority upon Korean Patent Application No. 2005-98218 filed on Oct. 18, 2005, the contents of which are herein incorporated by reference in its entirety.

FIELD OF THE INVENTION

The present invention relates to a driving voltage generating circuit for a display device such as liquid crystal display.

BACKGROUND OF THE INVENTION

Liquid crystal displays are used for both notebook computers and television sets, etc. Active matrix-type liquid crystal displays employing thin film transistor switching devices are especially useful to display moving images. Generally, a liquid crystal display includes two substrates, for example, a thin film transistor and a color filter substrate, combined with each other and liquid crystal injected between the two substrates. When an electric field is applied to the liquid crystal display and the intensity of the electric field is adjusted, the amount of light transmitted through the two substrates can be varied thereby to display a desired image.

The quality of the image displayed on the liquid crystal display is affected by the ambient temperature, becoming whiter as the temperature is lowered below normal room temperature and becoming blacker at temperatures above normal room temperature. The temperature characteristics of the thin film transistors cause it to deliver less charge to the LCD display at lower temperatures and overcharging the display at higher temperatures. Thus, technologies are required to prevent the image distortion due to the temperature condition.

SUMMARY OF THE INVENTION

The present invention provides a driving voltage generating circuit capable of preventing distortion of the image displayed by an LCD due to temperature variation. A driving voltage generating circuit in accordance with the invention includes a switching voltage generator, a reference voltage generator and a power voltage generator. The reference voltage generator has an operational amplifier that receives a sensing voltage indicating a temperature of the liquid crystal display via an inversion input terminal thereof and a power voltage input via a non-inversion input terminal thereof.

The operational amplifier amplifies the voltage difference between the sensing voltage and the power voltage and generates a reference voltage in inverse proportion to the temperature. The reference voltage from the operational amplifier is fedback to the inversion input terminal. The power voltage generator generates the gate-on voltage in response to the switching driving voltage and the reference voltage. According to another aspect of the present invention, a liquid crystal display includes a liquid crystal panel, a driving voltage generator and a driver. The liquid crystal panel senses the temperature of the liquid crystal to output a sensing voltage. The driving voltage generator generates a gate-on voltage in inverse proportion to the temperature in response to the sensing voltage. The driver drives the liquid crystal panel in response to the gate-on voltage. The gate-on voltage, in proportion to the temperature variation, is applied to the liquid crystal panel so that the liquid crystal display may uniformly display the image thereon without any distortion of the displayed image.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE EMBODIMENTS

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to", or "directly coupled to" another element or layer, there are no intervening elements or layers present. Like numbers refer to like elements throughout. As used herein, the term "and/or" includes any and all combinations of one or more of the associated listed items. It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Description

Figure 1:
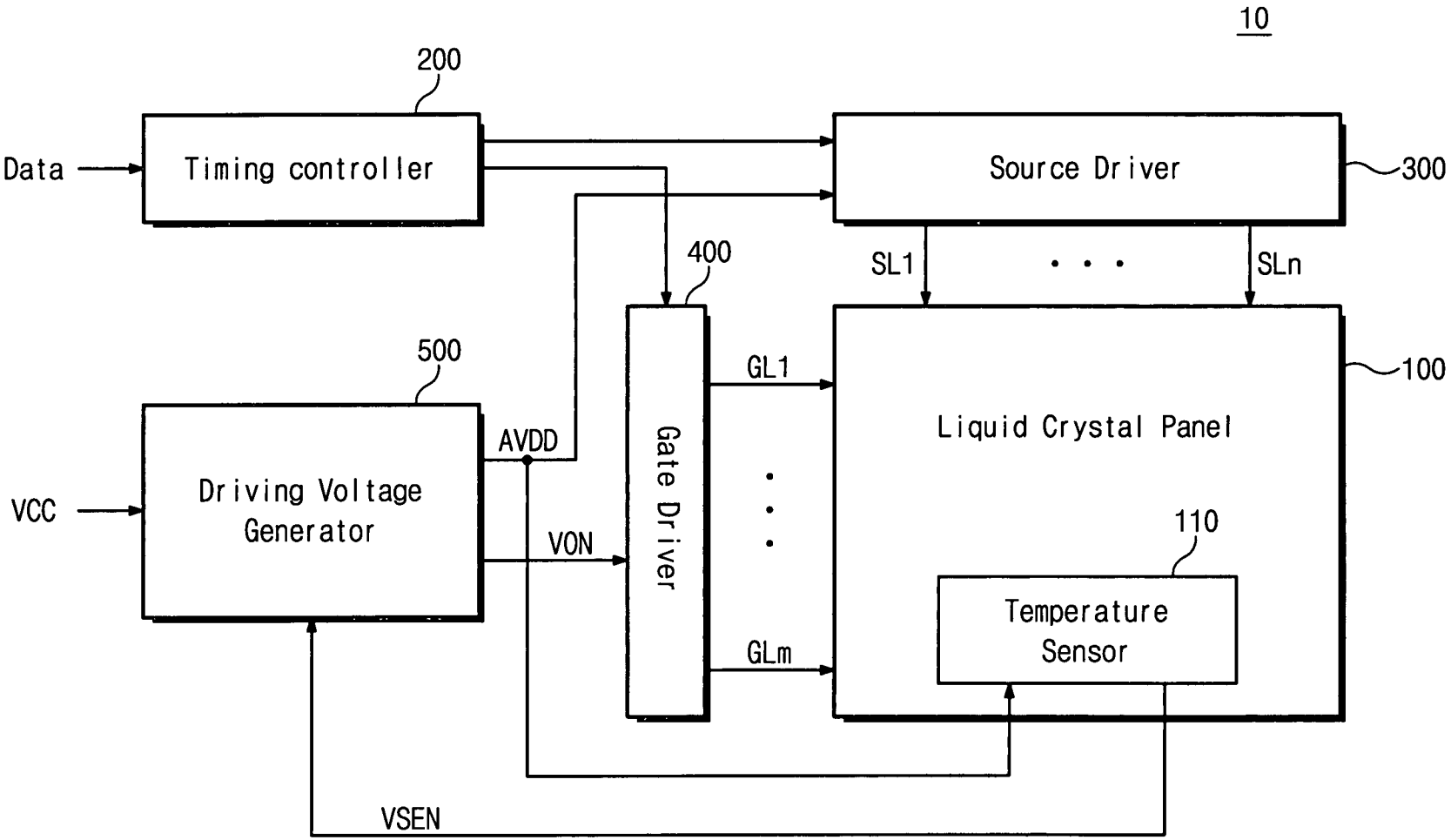
FIG. 1 is a block diagram showing a liquid crystal display according to an exemplary embodiment of the present invention.

FIG. 1 is a block diagram showing a liquid crystal display according to an exemplary embodiment of the present invention. Liquid crystal display 10 includes a liquid crystal panel 100, a timing controller 200, a source driver 300, a gate driver 400 and a driving voltage generator 500. Liquid crystal panel 100 includes a plurality of pixels respectively formed in pixel regions that is defined by a plurality of gate lines GL1-GLm and a plurality of source lines SL1-SLn intersecting with the gate lines GL1-GLm. Each of the pixels includes a thin film transistor, a storage capacitor reducing a current leakage from liquid crystal and a liquid crystal capacitor. The thin film transistor includes a gate electrode electrically connected to a corresponding gate line of the gate lines GL1-GLm, a source electrode electrically connected to a corresponding source line of the source lines SL1-SLn and a drain electrode electrically connected to a corresponding storage capacitor. The thin film transistor is turned on or turned off in response to a gate signal applied to the gate electrode thereof. The storage capacitor is electrically connected between the drain electrode of the thin film transistor and a ground, and the liquid crystal capacitor is electrically connected between the drain electrode of the thin film transistor and a common voltage VCOM.

Liquid crystal panel 100 includes a temperature sensor 110 sensing temperature variation of the liquid crystal panel 100 and outputs a sensing voltage VSEN. In the exemplary embodiment, an example of the temperature sensor 110 may be a thermistor whose resistance varies in accordance with ambient temperature. Timing controller 200 receives externally provided image data signals and outputs the image data signals in cooperation with timing acquired from source driver 300 and gate driver 400. The timing controller 200 also outputs control signals to control the source driver 300 and the gate driver 400.

Source driver (data driver) 300 includes a plurality of source driver integrated circuits (ICs). Responsive to the control signals applied from the timing controller 200 and a power voltage AVDD applied from the driving voltage generator 500, the source driver 300 outputs a source line driving signal to drive the source lines SL1-SLn formed on the liquid crystal panel 100.

The gate driver 400 includes a plurality of gate driver ICs and outputs a gate line driving signal to drive the gate lines GL1-GLm formed on the liquid crystal panel 100. The gate driver 400 includes a shift register that sequentially generates a scan pulse in response to the control signals from the timing controller 200 and a level shifter that shifts the voltage level of the scan pulse, to a level suitable for driving liquid crystal panel 100. When the scan pulse is sequentially applied to the gate lines GL1-GLm as a gate-on voltage VON, the gate lines GL1-GLm to which the gate-on voltage VON is applied is placed in a data writable state.

Driving voltage generator 500 generates voltages such as the power voltage AVDD and the gate-on voltage VON required from the liquid crystal display 10 from an externally provided input voltage VCC. The power voltage AVDD generated by driving voltage generator 500 and applied to the source driver 300 is a reference voltage for the voltage applied from the source driver 300 to the liquid crystal panel 100. Also, the gate-on voltage VON generated by the driving voltage generator 500 is applied to the gate driver 400 to turn on or off the thin film transistor of the liquid crystal panel 100.

In the exemplary embodiment, the gate-on voltage VON has a voltage level over about plus 20 volts, and the gate-off voltage VOFF has a voltage level under about minus 5 volts. The thin film transistor of the liquid crystal panel 100 has operation properties that vary with temperature and therefore vary the charge rate of the liquid crystal. Thus, in order to allow the thin film transistor to have stable operation properties regardless of the temperature condition, the gate-on voltage VON applied to the thin film transistor should be controlled to have a voltage level that is in inverse proportion to the temperature condition. In particular, since the operation properties of the thin film transistor are adversely affected when the thin film transistor is operated at lower than normal room temperature, a gate-on voltage VON having a high level is applied to the thin film transistor and when the thin film transistor is operated under a higher temperature than the room temperature, the gate-on voltage VON having a lower voltage level is applied to the thin film transistor to prevent overcharge of the liquid crystal. The driving voltage generator 500 receives the sensing voltage VSEN from the temperature sensor 110 to the gate-on voltage VON in proportion to the temperature detected by the temperature sensor 110.

Figure 2:
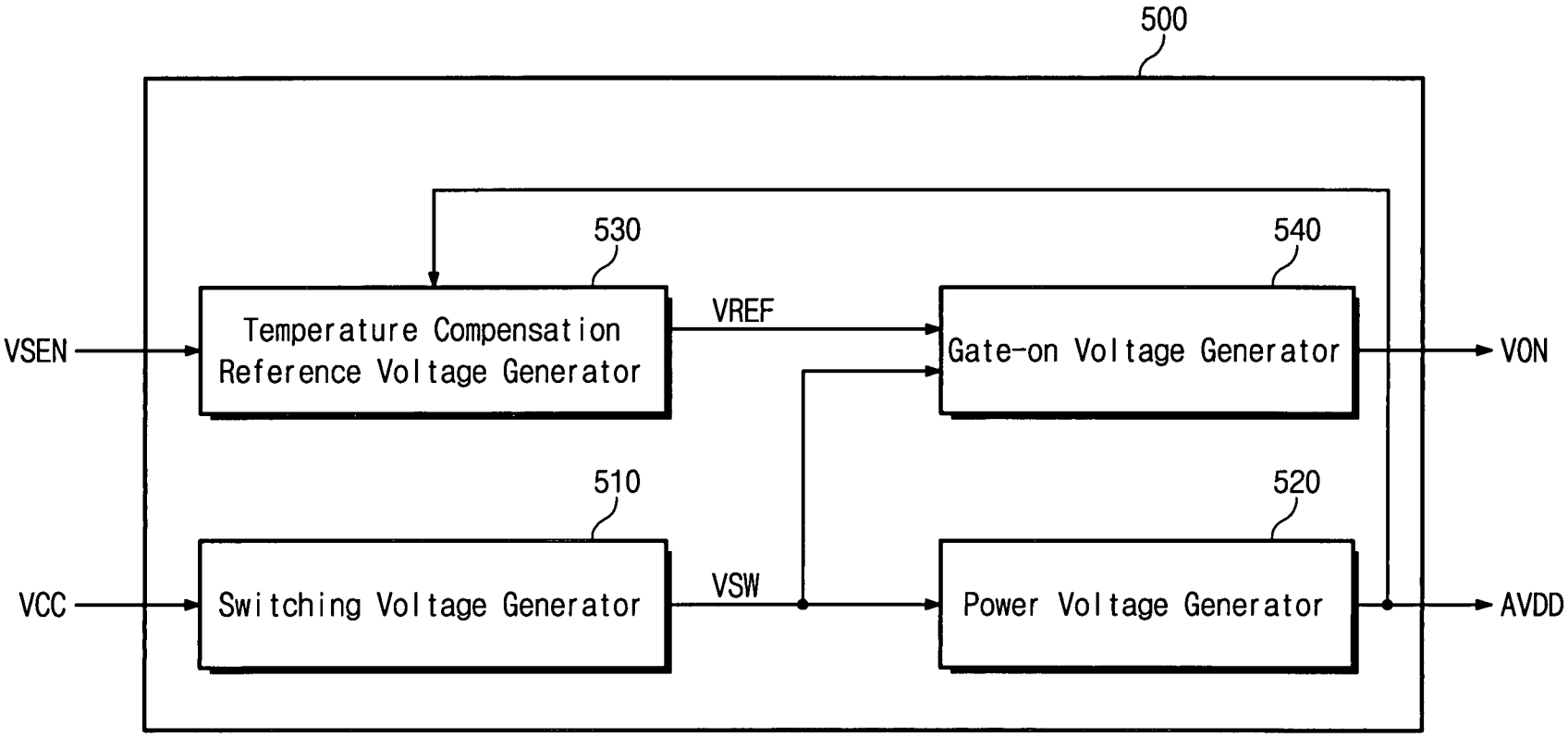
FIG. 2 is a block diagram showing the driving voltage generator in FIG. 1.

FIG. 2 is a block diagram showing the driving voltage generator in FIG. 1. Referring to FIG. 2, the driving voltage generator 500 includes a switching voltage generator 510, a power voltage generator 520, a temperature compensation reference voltage generator 530 and a gate-on voltage generator 540. The switching voltage generator 510 boosts the input voltage VCC to a predetermined voltage level to generate a switching pulse voltage VSW swinging between zero volts and the boosted input voltage VCC. For example, when the input voltage VCC having a voltage level of about 3.3 volts is applied to the switching voltage generator 510 and the switching voltage generator 510 has a boosting capability of three times with respect to the input voltage VCC, the switching voltage generator 510 generates the switching pulse voltage VSW swinging between zero volts and ten volts. The power voltage generator 520 rectifies the switching pulse voltage VSW provided from the switching pulse voltage generator 510 to generate the power voltage AVDD and stabilizes the voltage level of the driving power voltage AVDD.

The temperature compensation reference voltage generator 530 receives the sensing voltage VSEN from the temperature sensor 110 and the power voltage AVDD from the power voltage generator AVDD to generate a reference voltage VREF in inverse proportion to the detected temperature level by the temperature sensor 110. In other words, the temperature compensation reference voltage generator 530 generates a low reference voltage when the detected temperature level is higher than the room temperature, and the temperature compensation reference voltage generator 530 generates a high reference voltage when the detected temperature level is lower than the room temperature.

Gate-on voltage generator 540 generates the gate-on voltage VON in response to the reference voltage VREF from the temperature compensation reference voltage generator 530 and the switching pulse voltage VSW from the switching voltage generator 510. The gate-on voltage generator 540 includes a charge pump circuit to generate the gate-on voltage VON corresponding to a multiple (two or three times) of the switching pulse voltage VSW. Thus, the gate-on voltage VON outputted from the gate-on voltage generator 540 is in inverse proportion to the temperature variation of the liquid crystal panel 100.

Figure 3:
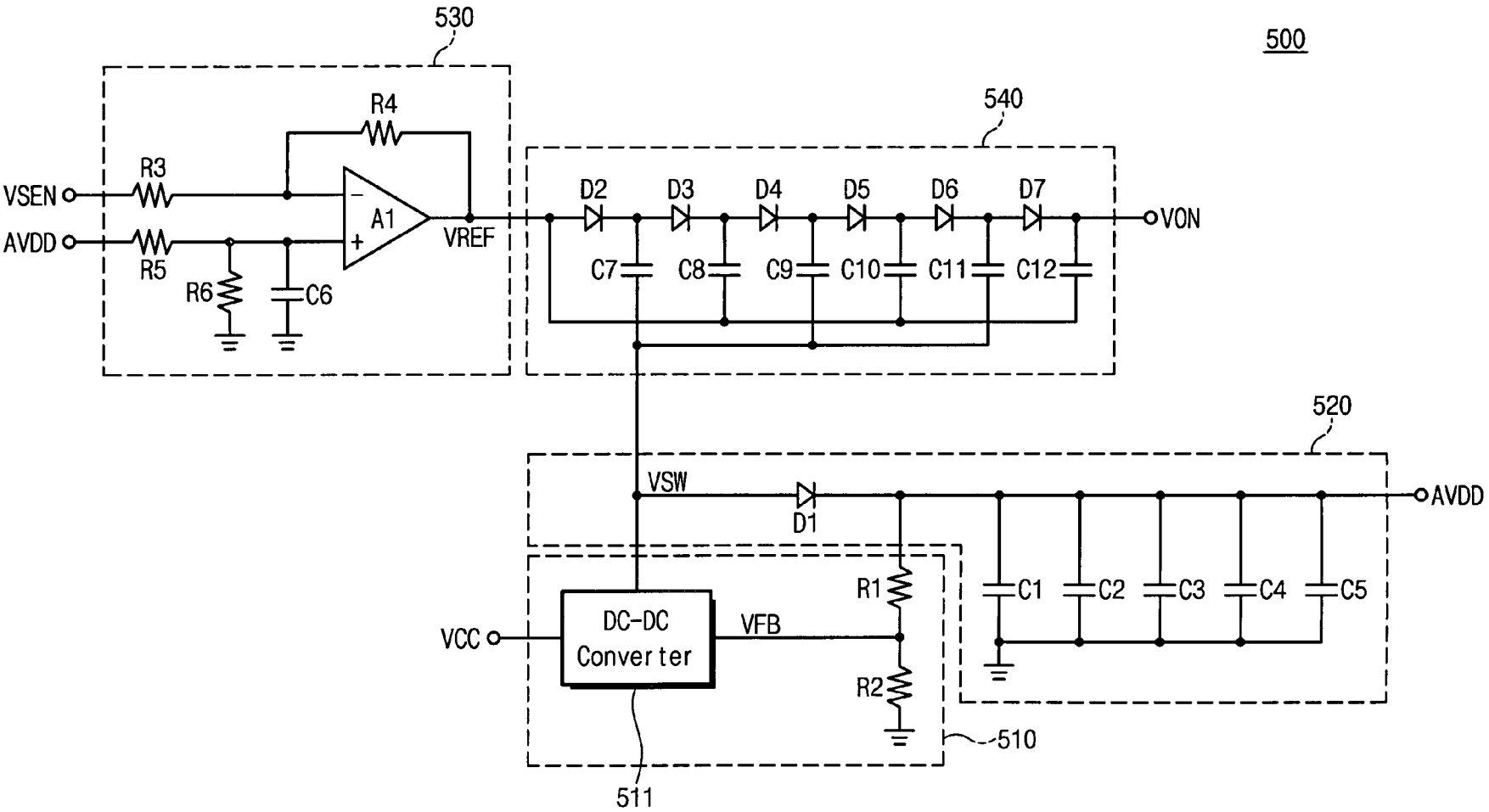
FIG. 3 is a circuit diagram showing the driving voltage generator of FIG. 2.
Figure 4:
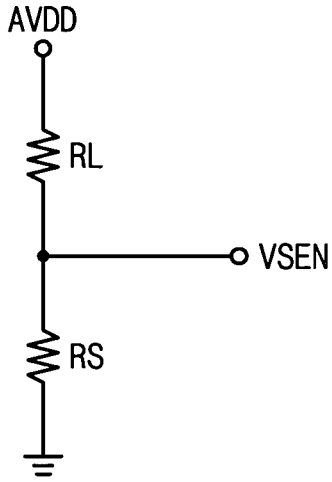
FIG. 4 is an equivalent circuit diagram shown the temperature sensor shown in FIG. 1.

FIG. 3 is a circuit diagram showing the driving voltage generator of FIG. 2. FIG. 4 is an equivalent circuit diagram shown the temperature sensor shown in FIG. 1. Referring to FIG. 3, the switching voltage generator 510 includes a direct current to direct current (DC-DC) converter 511, a first resistor R1 and a second resistor R2. The switching voltage generator 510 boosts the input voltage VCC to the predetermined voltage level corresponding to the multiple of the input voltage VCC and generates the switching pulse voltage VSW. The switching pulse voltage VSW that is voltage-divided by the first and second resistors R1 and R2 is feedback to the DC-DC converter 511, so that the DC-DC converter 511 may generate the switching pulse voltage VSW having a desired voltage level. The level of the switching pulse voltage VSW with respect to the input voltage VCC depends upon the boosting ability of the DC-DC converter 511. Power voltage generator 520 includes a first diode D1, a first capacitor C1, a second capacitor C2, a third capacitor C3, a fourth capacitor C4 and a fifth capacitor C5. The first diode D1 is connected between the output terminal of the DC-DC converter 511, from which the switching pulse voltage VSW is outputted, and the first resistor R1. The first diode D1 rectifies the switching pulse voltage VSW to generate the driving power voltage AVDD and blocks a reverse current flowing to the switching voltage generator 510. The first, second, third, fourth and fifth capacitors C1, C2, C3, C4 and C5 stabilize the voltage level of the driving power voltage AVDD.

Temperature compensation reference voltage generator 530 includes an operational amplifier A1, resistors R3, R4, R5 and R6 and a capacitor C6. The operational amplifier A1 receives the sensing voltage VSEN and the power voltage AVDD via an inversion input terminal thereof and a non-inversion input terminal thereof, respectively. The sensing voltage VSEN applied to the inversion input terminal of the operational amplifier A1 may be obtained from an equivalent circuit diagram shown in FIG. 4. As shown in FIG. 4, when the power voltage AVDD applied from the driving voltage generator 500 to the temperature sensor 110 is voltage-divided by a load resistor RL and a sensing resistor RS, the sensing voltage VSEN indicating a temperature variation may be obtained. The sensing resistor RS has a resistance that is variable according to the temperature.

$$RS = \rho\frac{L}{WD},\ \rho = \rho_o(1 + \alpha T) \tag{1}$$

(wherein ρ denotes a dielectric constant, L denotes a length of a resistor, W denotes a width of the resistor, D denotes a thickness of the resistor, α denotes a characteristic value of the resistor, and T denotes temperature.)

As shown in equation (1), the value of the sensing resistor RS is in proportion to the temperature variation. The sensing voltage VSEN of the sensing resistor RS shown in FIG. 4 is represented by the following equation (2).

$$VSEN = \frac{RS}{RS + RL}AVDD \tag{2}$$

As shown in equation (2), the sensing voltage VSEN is in proportion to the temperature variation.

Also, the reference voltage VREF outputted from the output terminal of the operational amplifier is represented by the following equation (3).

$$VREF = -\frac{R4}{R3}VSEN + \frac{1 + R4/R3}{1 + R5/R6}AVDD \tag{3}$$

As shown in equation (3), since the sensing voltage VSEN that is in proportion to the temperature variation is inputted into the inversion input terminal of the operational amplifier A1, the reference voltage VREF is in inverse proportion to the temperature variation.

In the exemplary embodiment, an example of the gate-on voltage generator 540 may include the charge pump configured to have six diodes D2, D3, D4, D5, D6 and D7 connected between the reference voltage VREF and the gate-on voltage VON in the forward direction and six capacitors C7, C8, C9, C10, C11 and C12. The gate-on voltage generator 540 pumps the switching pulse voltage VSW to the predetermined voltage level with reference to the reference voltage VREF to generate the gate-on voltage VON. Here, the gate-on voltage VON is in inverse proportion to the temperature variation since the reference voltage VREF applied to the gate-on voltage generator 540 is in inverse proportion to the temperature variation.

Figure 5:
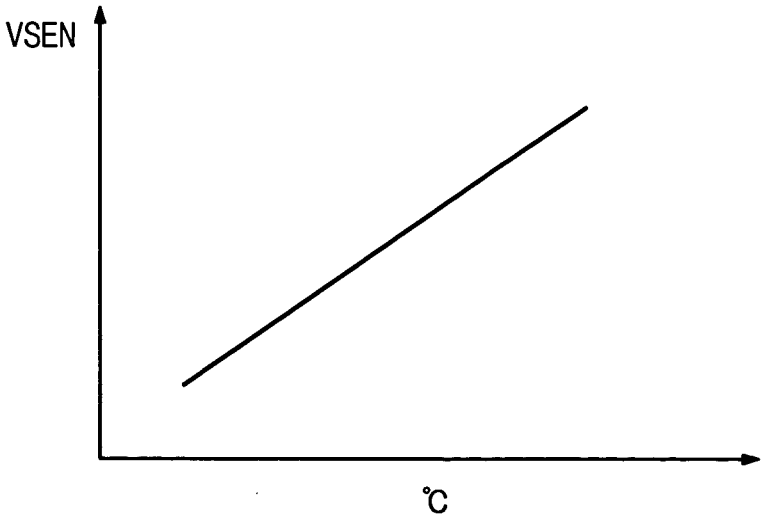
FIG. 5 is a graph showing a characteristic of the sensing voltage according to the temperature.
Figure 6:
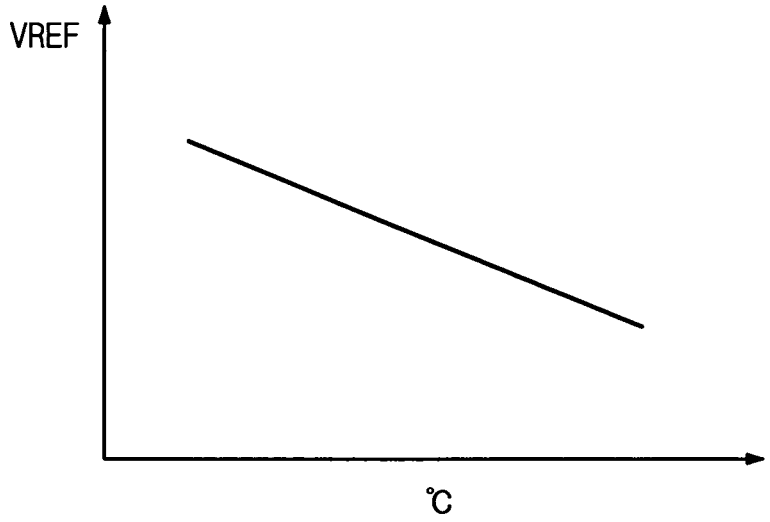
FIG. 6 is a graph showing a characteristic of the reference voltage according to the temperature.
Figure 7:
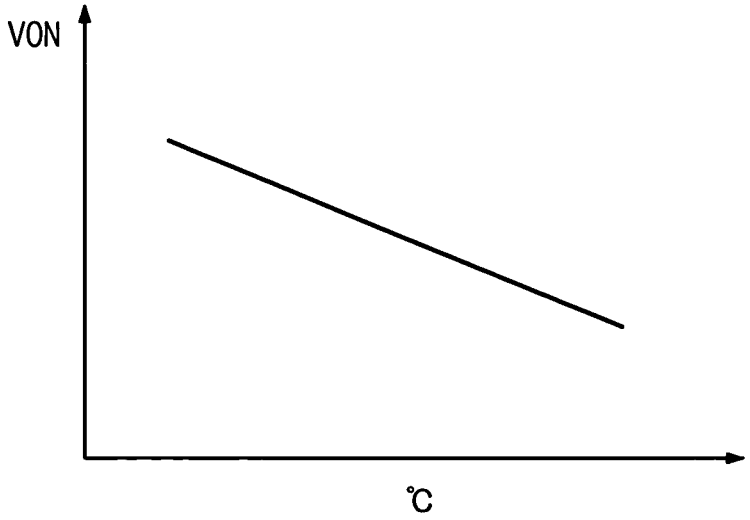
FIG. 7 is a graph showing a characteristic of the gate-on voltage according to the temperature.

FIG. 5 is a graph showing a characteristic of the sensing voltage according to the temperature. Referring to FIG. 5, the sensing voltage VSEN output from the temperature sensor 110 is in proportion to the temperature variation since the sensing resistor RS shown in FIG. 4 has the resistance in proportion to the temperature variation. FIG. 6 is a graph showing a characteristic of the reference voltage according to the temperature. As shown in FIG. 6, the temperature compensation voltage generator 530 in FIG. 3 inverts the sensing voltage VSEN in proportion to the temperature variation to generate the reference voltage VREF, so that the reference voltage VREF is in inverse proportion to the temperature variation. FIG. 7 is a graph showing a characteristic of the gate-on voltage according to the temperature. Referring to FIG. 7, the gate-on voltage generator 540 shown in FIG. 3 generates the gate-on voltage VON in response to the reference voltage VREF in inverse proportion to the temperature variation and the switching pulse voltage VSW. Thus, the gate-on voltage VON is in inverse proportion to the temperature variation.

As described above, the driving voltage generator 500 receives the sensing voltage VSEN from the temperature sensor 110 and generates the gate-on voltage VON in inverse proportion to the temperature variation. The gate-on voltage VON in proportion to the temperature variation is applied to the liquid crystal panel 100, and thus the liquid crystal display 10 may display a uniform image thereon regardless of the temperature variation thereof. Various properties of the driving voltage generating circuit may be applied to flat panel displays, for example, such as an electrochromic display (ECD), a digital mirror device (DMD), an actuated mirror device (AMD), a grating light value (GLV), a plasma display panel (PDP), an electro luminescent display (ELD), a light emitting diode (LED) display, a vacuum fluorescent display (VFD), etc.

Further, the liquid crystal display of the exemplary embodiment of the present invention may be applied to various electrics fields such as a large-sized television set, a high definition television set, a mobile computer, a camcorder, a display for an automobile, a multimedia device for a telecommunication, a virtual reality and so on. According to the above, the driving voltage generator generates the gate-on voltage in inverse proportion to the temperature variation. The gate-on voltage in proportion to the temperature variation is applied to the liquid crystal panel, and thus the liquid crystal display may uniformly display the image thereon without any distortion of the displayed image. Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A driving voltage generating circuit, comprising:

a switching voltage generator boosting an externally provided voltage to generate a switching driving voltage;

a reference voltage generator having an operational amplifier receiving a sensing voltage indicating a temperature of the liquid crystal display via an inversion input terminal thereof and a power voltage via a non-inversion input terminal thereof, the operational amplifier amplifying a voltage difference between the sensing voltage and the power voltage to generate a reference voltage in inverse proportion to the temperature, the reference voltage from the operational amplifier being feedback to the inversion input terminal;

a gate-on voltage generator to generate a gate-on voltage in response to the switching driving voltage and the reference voltage and to provide the gate-on voltage to a gate driver; and a power voltage generator rectifying the switching driving voltage to generate the power voltage having a constant voltage level and providing the generated power voltage to a source driver and the reference voltage generator.

2. The driving voltage generating circuit of claim 1, wherein the reference voltage generator further comprises:

a first resistor electrically connected to the inversion input terminal to provide the inversion input terminal with the sensing voltage; and a second resistor electrically connected between the inversion input terminal and an output terminal from which the reference voltage is outputted to feedback the reference voltage to the inversion input terminal.

3. The driving voltage generating circuit of claim 2, wherein the reference voltage generator further comprises:

a third resistor electrically connected to the non-inversion input terminal to provide the power voltage to the non-inversion input terminal;

a fourth resistor electrically connected between the non-inversion input terminal and a ground; and a capacitor electrically connected between the non-inversion input terminal and the ground.

4. The driving voltage generating circuit of claim 1, wherein the sensing voltage is the temperature of the liquid crystal display detected.

5. A liquid crystal display comprising:

a liquid crystal panel sensing a temperature of a liquid crystal to output a sensing voltage and having gate lines and data lines;

a driving voltage generator generating a gate-on voltage in inverse proportion to the temperature in response to the sensing voltage and a power voltage having a constant voltage level;

a gate driver driving the gate lines of the liquid crystal panel in response to the gate-on voltage and a source driver driving the data lines of the liquid crystal panel in response to the power voltage.

6. The liquid crystal display of claim 5, wherein the liquid crystal panel further comprises a temperature sensor to output the sensing voltage.

7. The liquid crystal display of claim 5, wherein the driving voltage generator comprises:

a switching voltage generator boosting an externally provided voltage to generate a switching driving voltage;

a reference voltage generator receiving the sensing voltage to generate a reference voltage in inverse proportion to the temperature;

a gate-on voltage generator generating the gate-on voltage in response to the switching driving voltage and the reference voltage; and a power voltage generator rectifying the switching driving voltage to generate the power voltage having a constant voltage level and providing the generated power voltage to the reference voltage generator.

8. A method of driving a liquid crystal display, comprising:

sensing a temperature of a liquid crystal to output a sensing voltage;

boosting an input voltage to output a switching driving voltage;

outputting a reference voltage in inverse proportion to the temperature in response to the sensing voltage;

generating a gate-on voltage in inverse proportion to the temperature in response to the reference voltage and the switching driving voltage and providing the generating gate-on voltage to a gate driver; and rectifying the switching driving voltage to generate power voltage having a constant voltage level and providing the generated power voltage to a source driver.

* * * * *